US012049792B2

(12) United States Patent
Zhu et al.

(10) Patent No.: US 12,049,792 B2
(45) Date of Patent: Jul. 30, 2024

(54) DOUBLE-CHANNEL FLUID INJECTION APPARATUS

(71) Applicants: SINOPEC PETROLEUM ENGINEERING TECHNOLOGY SERVICE CO., LTD, Beijing (CN); SINOPEC SHENGLI PETROLEUM ENGINEERING CO., LTD, Shandong (CN); DRILLING TECHNOLOGY RESEARCH INSTITUTE OF SINOPEC SHENGLI PETROLEUM ENGINEERING CO., LTD, Shandong (CN)

(72) Inventors: Huangang Zhu, Shandong (CN); Jiancheng Li, Shandong (CN); Haoyu Sun, Shandong (CN); Qiang Cao, Shandong (CN); Yong Chen, Shandong (CN); Dejing Yang, Shandong (CN); Zongqing Li, Shandong (CN); Chang Wang, Shandong (CN); Rongrong Song, Shandong (CN); Ping Xu, Shandong (CN)

(73) Assignees: SINOPEC PETROLEUM ENGINEERING TECHNOLOGY SERVICE CO., LTD., Beijing (CN); SINOPEC SHENGLI PETROLEUM ENGINEERING CO., LTD., Shandong (CN); DRILLING TECHNOLOGY RESEARCH INSTITUTE OF SINOPEC SHENGLI PETROLEUM ENGINEERING CO., LTD., Shandong (CN)

( * ) Notice: Subject to any disclaimer, the term of this patent is extended or adjusted under 35 U.S.C. 154(b) by 288 days.

(21) Appl. No.: 17/618,008

(22) PCT Filed: Jun. 10, 2020

(86) PCT No.: PCT/CN2020/095466

§ 371 (c)(1),
(2) Date: Dec. 10, 2021

(87) PCT Pub. No.: WO2020/249028

PCT Pub. Date: Dec. 17, 2020

(65) Prior Publication Data

US 2022/0243540 A1 Aug. 4, 2022

(30) Foreign Application Priority Data

Jun. 13, 2019 (CN) ..... 201910511436.X

(51) Int. Cl.
*E21B 17/18* (2006.01)
*E21B 21/14* (2006.01)
(Continued)

(52) U.S. Cl.
CPC ..... *E21B 17/18* (2013.01); *E21B 21/14* (2013.01); *E21B 33/03* (2013.01); *E21B 33/068* (2013.01)

(58) Field of Classification Search
CPC ..... E21B 17/18; E21B 21/14; E21B 33/03; E21B 33/068; E21B 33/085
See application file for complete search history.

(56) References Cited

U.S. PATENT DOCUMENTS 4,531,580 A * 7/1985 Jones ..... E21B 33/085 277/343
9,683,422 B2 * 6/2017 Boyd ..... E21B 33/068
(Continued)

FOREIGN PATENT DOCUMENTS

CN 106287077 A 1/2017
CN 207111013 U 3/2018
(Continued)

OTHER PUBLICATIONS

International Search Report (PCT/ISA/210) with translation and Written Opinion (PCT/ISA/237) mailed on Sep. 16, 2020, by the China National Intellectual Property Administration (ISA/CN) as the International Searching Authority for International Application No. PCT/CN/2020/095466. (9 pages).

*Primary Examiner* — Robert E Fuller
*Assistant Examiner* — Neel Girish Patel
(74) *Attorney, Agent, or Firm* — BUCHANAN, INGERSOLL & ROONEY PC

(57) ABSTRACT

A double-channel fluid injection apparatus includes a main shaft, a bearing box, and a sealing box. The main shaft
(Continued)

includes an outer tube and an inner tube. An internal channel of the inner tube and a vertical through channel constitute a first fluid passageway. The inner tube and the outer tube form an annular gap, and a channel D is radially formed at a lower part of the outer tube and is in communication with the annular gap, thus constituting a second fluid passageway. The bearing box is mounted on a boss of the outer tube. The sealing box includes a sealing cylinder fixedly connected to a lower end of a lower end cap of the bearing box. A channel E in communication with the second fluid passageway is radially formed at a position of the sealing cylinder corresponding to the channel of the outer tube.

6 Claims, 1 Drawing Sheet

(51) Int. Cl.
*E21B 33/03* (2006.01)
*E21B 33/068* (2006.01)

(56) References Cited

U.S. PATENT DOCUMENTS

| | | | | |
|---|---|---|---|---|
| 10,895,152 | B1 * | 1/2021 | Young, III | E21C 37/14 |
| 2003/0106712 | A1 * | 6/2003 | Bourgoyne | E21B 21/08 166/358 |
| 2006/0037782 | A1 * | 2/2006 | Martin-Marshall | E21B 33/085 166/85.4 |
| 2008/0121429 | A1 * | 5/2008 | Bamford | E21B 41/08 166/363 |
| 2009/0101351 | A1 * | 4/2009 | Hannegan | E21B 33/085 166/350 |
| 2009/0101411 | A1 * | 4/2009 | Hannegan | E21B 33/06 175/48 |
| 2011/0036638 | A1 * | 2/2011 | Sokol | E21B 21/085 175/325.3 |
| 2013/0140087 | A1 | 6/2013 | Koch et al. | |

FOREIGN PATENT DOCUMENTS

| | | | |
|---|---|---|---|
| CN | 108104749 | A | 6/2018 |
| CN | 207436908 | U | 6/2018 |
| CN | 108799502 | A | 11/2018 |

* cited by examiner

DOUBLE-CHANNEL FLUID INJECTION APPARATUS

TECHNICAL FIELD

The present invention relates to an injection apparatus in the field of drilling tools, in particular to a double-channel fluid injection apparatus used for aerated drilling with a double-walled drill pipe.

BACKGROUND ART

In recent years, in the drilling process in such fields as geothermal drilling and oil drilling, many wells have been suffered by vicious lost circulation, which severely restricts the drilling progress and drilling ratio of formation. The drilling of leaking formation can be performed by using aerated drilling, which can be divided, in terms of aerated process, into aerated drilling inside a drill pipe, aerated drilling with a casing and a parasitic pipe, aerated drilling with a concentric casing, and aerated drilling with a double-walled drill pipe. Compared with the traditional aerated drilling inside a drill pipe, the aerated drilling with a double-walled drill pipe has the following advantages: (1) gas and liquid are injected separately, which is more efficient and easy to control, and the optimal wellbore ECD gradient distribution can be obtained and controlled by adjusting various parameters (e.g., drilling fluid density, displacement, double-walled drilling depth, gas volume, etc.); (2) the drilling fluid density and displacement are not reduced, such that the advantages of downhole speed-up tools can be better utilized: (3) less aerated equipment is required, and the pressure is lower with good economy: and (4) injection of pure liquid phase in the drill pipe allows for directional service using conventional MWD. With the implementation of the aerated drilling with a double-walled drill pipe, it is expected to significantly reduce the failure of well leakage treatment in normal low-pressure leak-prone formations, solve the problem of safe and efficient drilling for leak-collapse coexisting negative window formations, and further guarantee the success rate of drilling operation, with good promotion and application prospects. New apparatus for the aerated drilling with a double-walled drill pipe mainly includes a double-walled drill pipe, a double-channel fluid injection apparatus, and a downhole gas-liquid mixer. For a rotary drilling rig, an upper part of the double-channel fluid injection apparatus is connected to a drilling rig swivel, and a lower part thereof is connected to the double-walled Kelly bar. For a top drive drilling rig, the upper part of the double-channel fluid injection apparatus is connected to a top drive, and the lower part thereof is connected to the double-walled drill pipe. During the use of the double-channel fluid injection apparatus, gas is injected from a bypass port, while liquid is injected from an axial channel, thus mainly achieving injection of both gas and liquid media and rotary sealing of fluid. The existing double-channel fluid injection apparatus has the problems of non-adjustable sealing interference, short sealing life, and low safety in well control. These problems have become one of the key problems restricting the development of the aerated drilling technique with a double-walled drill pipe.

SUMMARY OF THE INVENTION

Aiming at the problems existing in the prior art, the objective of the present invention is to provide a double-channel fluid injection apparatus, in order to improve the sealing life and pressure-bearing level of the double-channel fluid injection apparatus.

The double-channel fluid injection apparatus is connected to the drilling rig swivel at an upper part thereof, and to the double-walled Kelly bar at a lower part thereof. The double-walled Kelly bar includes an outer square drill pipe and an inner inserting tube, which is inserted into the outer square drill pipe to form two channels, i.e., an annular gap A between the inner inserting tube and the outer square drill pipe, and an internal channel A of the inner inserting tube.

The objective of the present invention is realized as follows.

A double-channel fluid injection apparatus comprises a main shaft, a bearing box and a sealing box. The main shaft comprises an outer tube and an inner tube, the outer tube being cylindrical and provided with a vertical through channel C extending axially therein, with a stepped hole recessed outwardly at an upper end of the channel C. The inner tube is shaped as a round tube, with an outwardly extending boss formed at an upper end thereof, and is inserted into the channel C of the outer tube from top to bottom, so that a lower end face of the boss of the inner tube is abutted against a lower end face of the stepped hole of the outer tube, while an outer edge of the boss of the inner tube is fixedly connected with an inner edge of the stepped hole of the outer tube. The inner tube is provided therein with a channel B, which, together with the vertical through channel C, constitutes a first fluid passageway. An annular channel formed by a lower portion of an outer edge of the inner tube and a lower portion of an inner edge of the outer tube is an annular gap B, wherein a lower part of the outer tube is provided with a channel D extending radially, which is in communication with the annular gap B to constitute a second fluid passageway. A connecting element is arranged at each of an upper end and a lower end of the outer tube, and a plug-in sealing element is arranged at a lower end of the inner tube.

An outer edge of an upper part of the outer tube is provided with a boss, on which the bearing box is mounted to form a rotatable and sealable fit with the outer tube.

The sealing box comprises a sealing cylinder of a cylindrical structure, which is fixedly connected to a lower end of a lower end cap of the bearing box, and constitutes a rotatable and sealable fit with the outer tube, wherein a channel E extending radially is formed at a position of the sealing cylinder corresponding to the channel D at the lower part of the outer tube, the channel E being in communication with the second fluid passageway.

The above technical solution further includes the following.

The bearing box includes an upper end cap, the lower end cap, a housing, a bearing set, end cap sealing rings, and oil seals. The bearing set is mounted above and below the boss arranged at the outer edge of the upper part of the outer tube, and the housing is mounted around the bearing set. The upper end cap and the lower end cap are respectively mounted at an upper end and a lower end of the housing. The end cap sealing rings are respectively mounted between the upper end cap and the housing and between the lower end cap and the housing. The oil seals are respectively mounted between the upper end cap and the outer tube and between the lower end cap and the outer tube.

The sealing box further comprises an upper sliding sleeve, a lower sliding sleeve, an upper sealing ring, a lower sealing ring and a lower sealing cap. The lower sealing cap is mounted on a lower end of the sealing cylinder, and the sealing cylinder and the lower sealing cap are both sleeved on the outer edge of the outer tube. A channel E extending radially is formed in a middle part of the sealing cylinder, and the upper sealing ring and the upper sliding sleeve are arranged between an inner edge of the sealing cylinder and the outer edge of the outer tube and between the channel E and the lower end cap of the bearing box, respectively, the upper sealing ring being located below the upper sliding sleeve. Between the lower end cap of the bearing box and the sealing cylinder an upper piston chamber is formed, in which the upper sliding sleeve is arranged, and a radial channel F in communication with the upper piston chamber is formed in an upper part of the sealing cylinder, so that a part of hydraulic medium flows to the channel F to drive the upper sliding sleeve to press the upper sealing ring. The lower sealing ring and the lower sliding sleeve are arranged between the inner edge of the sealing cylinder and the outer edge of the outer tube and between the channel E and the lower sealing cap, the lower sealing ring being located above the lower sliding sleeve. Between the lower sealing cap and the sealing cylinder a lower piston chamber is formed, in which the lower sliding sleeve is arranged, and a radial channel G in communication with the lower piston chamber is formed in a lower part of the sealing cylinder, so that another part of hydraulic medium flows to the channel G to drive the lower sliding sleeve to press the lower sealing ring.

Rotary seals are further arranged between the upper sealing ring and the channel E and between the lower sealing ring and the channel E, respectively.

The upper sealing ring and the lower sealing ring are V-shaped combined sealing rings.

The outer edge of the boss of the inner tube is connected to the inner edge of the stepped hole of the outer tube through threads, and a sealing ring A is arranged between the inner tube and the outer tube.

The present invention has the following advantages. On the one hand, by adjusting the pressure of medium from a hydraulic station, the degree of compression of the upper and lower sliding sleeves on the upper and lower sealing rings can be adjusted, so as to adjust the amount of the sealing interference and achieve the objective of adjusting the rotational torque, the seal abrasion degree and the pressure-bearing level. On the other hand, when such emergencies as high pressure of well control occur, the pressure of medium from the hydraulic station may be increased to ensure the sealable pressure-bearing capacity of the bypass port and improve the safety of well control.

BRIEF DESCRIPTION OF THE DRAWINGS

The drawing schematically shows the structure of a double-channel fluid injection apparatus of the present invention.

List of references: 1 main shaft; 2 bearing box; 3 sealing box; 10 outer tube; 11 inner tube; 12 sealing ring A; 13 annular gap B; 14 channel B; 15 channel D; 20 upper end cap; 21 lower end cap; 22 housing; 23 bearing set; 24 oil seals; 25 forced filling oil cup; 26 end cap sealing rings; 30 sealing cylinder; 31 lower sealing cap; 32 upper rotary seal; 33 upper sealing ring; 34 upper sliding sleeve; 35 channel F; 36 channel E; 37 lower rotary seal; 38 lower sealing ring; 39 channel G; and 310 lower sliding sleeve.

DETAILED DESCRIPTION OF THE EMBODIMENTS

Figure 1:
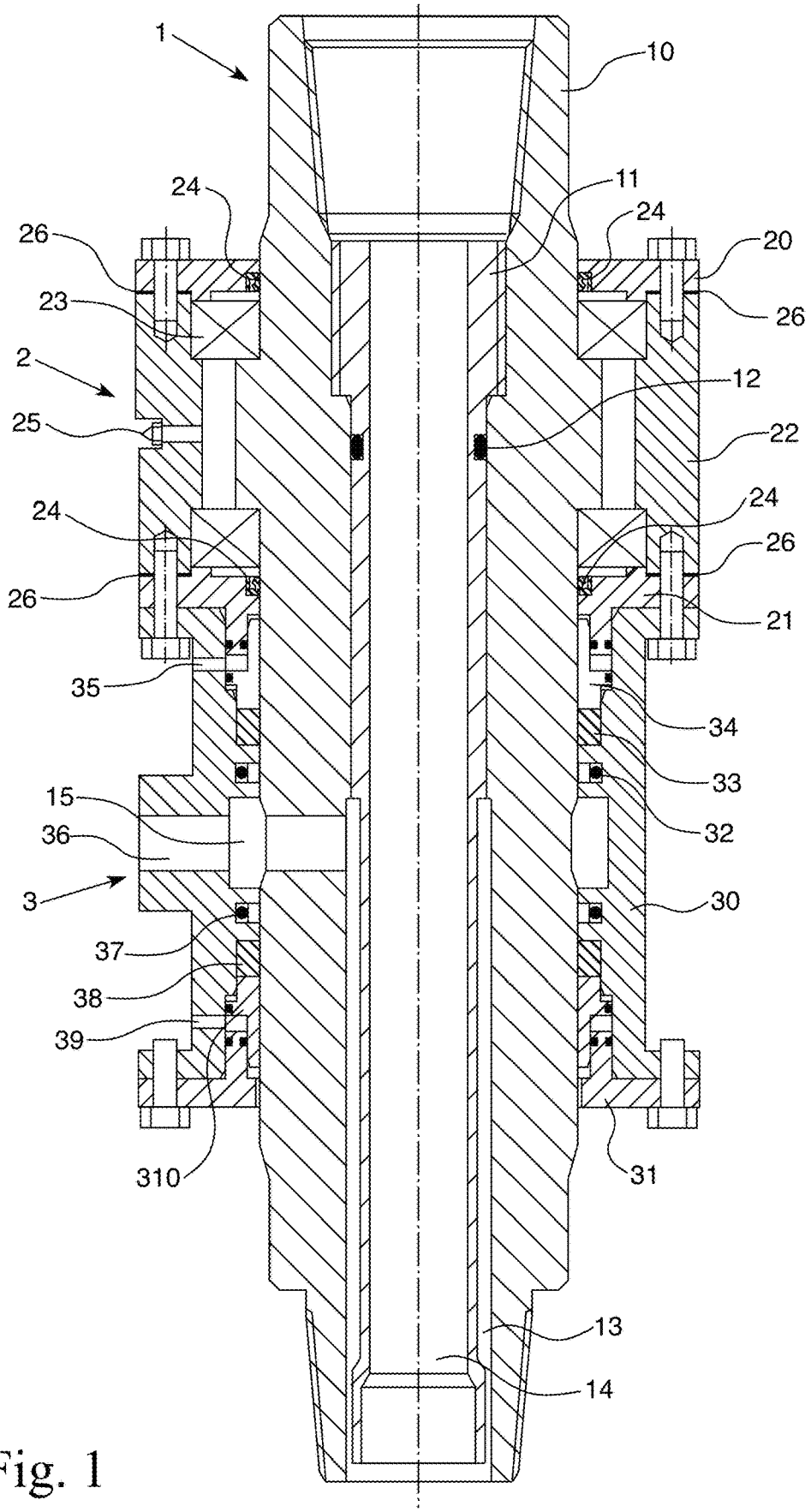

The present invention is further described below in combination with accompanying drawings.

Embodiment 1

The double-channel fluid injection apparatus includes a main shaft 1, a bearing box 2, and a sealing box 3. The main shaft 1 includes an outer tube 10 and an inner tube 11. The outer tube 10 is cylindrical, and is provided with a vertical through channel C extending axially in the outer tube 10, wherein a stepped hole recessed outwardly is formed at an upper end of the channel C. The inner tube 11 is shaped as a round tube, with an outwardly extending boss formed at an upper end thereof. The inner tube 11 is inserted into the channel C of the outer tube 10 from top to bottom, so that a lower end face of the boss of the inner tube 11 is abutted against a lower end face of the stepped hole of the outer tube 10, while an outer edge of the boss of the inner tube 11 is fixedly connected with an inner edge of the stepped hole of the outer tube 10. The inner tube 11 is provided therein with a channel B 14, which, together with the vertical through channel C, constitutes a first fluid passageway. An annular channel formed by a lower portion of an outer edge of the inner tube 11 and a lower portion of an inner edge of the outer tube 10 is an annular gap B 13. A lower part of the outer tube 10 is provided with a channel D 15 extending radially, which is in communication with the annular gap B 13 to constitute a second fluid passageway. A connecting element is arranged at each of an upper end and a lower end of the outer tube 10, and a plug-in sealing element is arranged at a lower end of the inner tube 11.

An outer edge of an upper part of the outer tube 10 is provided with a boss, on which the bearing box 2 is mounted to form a rotatable and sealable fit with the outer tube 10.

The sealing box 3 includes a sealing cylinder 30 of a cylindrical structure, which is fixedly connected to a lower end of a lower end cap 21 of the bearing box, and constitutes a rotatable and sealable fit with the outer tube 10. A channel E 36 extending radially is formed at a position of the sealing cylinder 30 corresponding to the channel D 15 at the lower part of the outer tube 10, and is in communication with the second fluid passageway.

Embodiment 2

In addition to those components of Embodiment 1, the double-channel fluid injection apparatus of Embodiment 2 further includes the following components.

The bearing box 2 includes an upper end cap 20, a lower end cap 21, a housing 22, a bearing set 23, an end cap sealing rings 26, and an oil seals 24. The bearing set 23 is mounted above and below the boss arranged at the outer edge of the upper part of the outer tube 10, and the housing 22 is mounted around the bearing set 23. The upper end cap 20 and the lower end cap 21 are respectively mounted at an upper end and a lower end of the housing. The end cap sealing rings 26 are respectively mounted between the upper end cap 20 and the housing 22 and between the lower end cap 21 and the housing 22. The oil seals 24 are respectively mounted between the upper end cap 20 and the outer tube 10 and between the lower end cap 21 and the outer tube 10.

The sealing box 3 further includes an upper sliding sleeve 34, a lower sliding sleeve 310, an upper sealing ring 33, a lower sealing ring 38 and a lower sealing cap 31. The lower sealing cap 31 is mounted on a lower end of the sealing cylinder 30, and the sealing cylinder 30 and the lower sealing cap 31 are both sleeved on the outer edge of the outer tube 10. A channel E 36 extending radially is formed in a middle part of the sealing cylinder 30. The upper sealing ring 33 and the upper sliding sleeve 34 are arranged between an inner edge of the sealing cylinder 30 and an outer edge of the outer tube 10 and between the channel E 36 and the lower end cap 21 of the bearing box, respectively. The upper sealing ring 33 is located below the upper sliding sleeve 34. Between the lower end cap 21 of the bearing box and the sealing cylinder 30 an upper piston chamber is formed, in which the upper sliding sleeve 34 is arranged. A radial channel F 35 in communication with the upper piston chamber is formed in an upper part of the sealing cylinder 30. A part of hydraulic medium can flow to the channel F 35 to drive the upper sliding sleeve 34 to press the upper sealing ring 33. The lower sealing ring 38 and the lower sliding sleeve 310 are arranged between the inner edge of the sealing cylinder 30 and the outer edge of the outer tube 10 and between the channel E 36 and the lower sealing cap 31. The lower sealing ring 38 is located above the lower sliding sleeve 310. Between the lower sealing cap 31 and the sealing cylinder 30 a lower piston chamber is formed, in which the lower sliding sleeve 310 is arranged. A radial channel G 39 in communication with the lower piston chamber is formed in a lower part of the sealing cylinder 30. Another part of hydraulic medium can flow to the channel G 39 to drive the lower sliding sleeve 310 to press the lower sealing ring 38.

Rotary seals are further arranged between the upper sealing ring 33 and the channel E 36 and between the lower sealing ring 38 and the channel E 36, respectively.

The upper sealing ring 33 and the lower sealing ring 38 are both V-shaped combined sealing rings.

The outer edge of the boss of the inner tube 11 is connected to the inner edge of the stepped hole of the outer tube 10 through threads, and a sealing ring A 12 is arranged between the inner tube 11 and the outer tube 10.

Typical Embodiment 3

The double-channel fluid injection apparatus is connected to a drilling rig swivel at an upper part thereof, and to a double-walled Kelly bar at a lower part thereof. The double-walled Kelly bar includes an outer square drill pipe and an inner inserting tube. The inner inserting tube is inserted into the outer square drill pipe to form two channels, including an annular gap A between the inner inserting tube and the outer square drill pipe, and an internal channel A of the inner inserting tube.

With reference to the drawing, the double-channel fluid injection apparatus includes a main shaft 1, a bearing box 2, a sealing box 3, and a hydraulic station (not shown). The main shaft 1 includes an outer tube 10 and an inner tube 11. The outer tube 10 is cylindrical, and is provided with a vertical through channel C extending axially in the outer tube 10, wherein a stepped hole recessed outwardly is formed at an upper end of the channel C. The inner tube 11 is shaped like a round tube, with an outwardly extending boss formed at an upper end thereof. The inner tube 11 is inserted into the channel C of the outer tube 10 from top to bottom, so that a lower end face of the boss of the inner tube 11 is abutted against a lower end face of the stepped hole of the outer tube 10, while an outer edge of the boss of the inner tube 11 is fixedly connected with an inner edge of the stepped hole of the outer tube 10 through threads. The inner tube 11 is provided therein with a channel B 14. An annular channel formed by a lower portion of an outer edge of the inner tube 11 and a lower portion of an inner edge of the outer tube 10 is an annular gap B 13. A sealing ring A 12 is arranged between the inner tube 11 and the outer tube 10 to prevent fluid in the annular gap B 13 from flowing upward, thus avoiding upward flow of fluid in the annular gap B 13 to a position between the boss of the inner tube 11 and the stepped hole of the outer tube 10. A lower part of the outer tube 10 is provided with a channel D 15 extending radially, which is in communication with the annular gap B 13. The outer tube 10 is connected to a drilling rig swivel at the upper end thereof, and to the outer square drill pipe at the lower end thereof. The upper end of the inner inserting tube is inserted and sealed together with the lower end of the inner tube 11. An inner channel of the drilling rig swivel, the channel B 14 and the channel A form a first fluid passageway, while the channel D 15, the annular gap B 13 and the annular gap A form a second fluid passageway.

An outer edge of the upper part of the outer tube 10 is provided with a boss, on which the bearing box 2 is mounted. The bearing box 2 includes an upper end cap 20, a lower end cap 21, a housing 22, a bearing set 23, an end cap sealing rings 26, and an oil seals 24. The bearing set 23 is mounted above and below the boss arranged at the outer of the upper part of the outer tube 10, and the housing 22 is mounted around the bearing set 23. The upper end cap 20 and the lower end cap 21 are respectively mounted at an upper end and a lower end of the housing. The end cap sealing rings 26 are respectively mounted between the upper end cap 20 and the housing 22 and between the lower end cap 21 and the housing 22. The oil seals 24 are respectively mounted between the upper end cap 20 and the outer tube 10 and between the lower end cap 21 and the outer tube 10. The bearing box 2 can be rotatable relative to the outer tube 10. The bearing box 2 is provided with a forced filling oil cup 25, by means of which grease is injected to lubricate the bearing set 23.

The sealing box 3 includes a sealing cylinder 30, an upper sliding sleeve 34, a lower sliding sleeve 310, an upper sealing ring 33, a lower sealing ring 38 and a lower sealing cap 31. The sealing cylinder 30 is of a cylindrical structure, and fixedly connected to a lower end of the lower end cap 21 of the bearing box. The lower sealing cap 31 is mounted at a lower end of the sealing cylinder 30, and the sealing cylinder 30 and the lower sealing cap 31 are both sleeved on the outer edge of the outer tube 10. A channel E 36 extending radially is formed in a middle part of the sealing cylinder 30, and is in communication with the second fluid passageway.

The upper sealing ring 33 and the upper sliding sleeve 34 are arranged between an inner edge of the sealing cylinder 30 and an outer edge of the outer tube 10 and between the channel E 36 and the lower end cap 21 of the bearing box. The upper sealing ring 33 is located below the upper sliding sleeve 34. Between the lower end cap 21 of the bearing box and the sealing cylinder 30 an upper piston chamber is formed, in which the upper sliding sleeve 34 is arranged. A radial channel F 35 in communication with the upper piston chamber is formed in the upper part of the sealing cylinder 30. A part of hydraulic medium from the hydraulic station can flow to the channel F 35 to drive the upper sliding sleeve 34 to press the upper sealing ring 33.

The lower sealing ring 38 and the lower sliding sleeve 310 are arranged between the inner edge of the sealing cylinder 30 and the outer edge of the outer tube 10 and between the channel E 36 and the lower sealing cap 31. The lower sealing ring 38 is located above the lower sliding sleeve 310. Between the lower sealing cap 31 and the sealing cylinder 30 a lower piston chamber is formed, in which the lower sliding sleeve 310 is arranged. A radial channel G 39 in communication with the lower piston chamber is formed in the lower part of the sealing cylinder 30. Another part of hydraulic medium from the hydraulic station can flow to the channel G 39 to drive the lower sliding sleeve 310 to press the lower sealing ring 38. The upper sealing ring 33 and the lower sealing ring 38 can prevent fluid in the second fluid passageway from leaking through a gap formed between the sealing cylinder and the outer tube. The upper sealing ring 33 and the lower sealing ring 38 are both V-shaped combined sealing rings.

Rotary seals are further arranged between the upper sealing ring 33 and the channel E 36 and between the lower sealing ring 38 and the channel E 36, respectively, i.e., an upper rotary seal 32 and a lower rotary seal 37, respectively. The upper rotary seal 32 and the lower rotary seal 37 may be rotary Glyd rings or rotary spring seals.

In drilling, the pressure of hydraulic medium from the hydraulic station can be adjusted, and the upper sliding sleeve 34 and the lower sliding sleeve 310 compress the upper sealing ring 33 and lower sealing ring 38, respectively. In this manner, the upper sealing ring 33 and the lower sealing ring 38 are suitably compressed, thus ensuring that fluid in the second fluid passageway will not leak out of the sealing box 2. When the pressure in the well increases, the pressure of hydraulic medium from the hydraulic station can be increased, such that the upper sealing ring 33 and the lower sealing ring 38 maintain a good sealing ability. The pressure of the hydraulic medium changes with the change of pressure in the second fluid passageway, thereby ensuring a reasonable rotational torque of the sealing box 2, reducing the abrasion of the upper sealing ring 33 and the lower sealing ring 38, and ensuring seal reliability even in cases such as abrupt high pressure.

Although embodiments of the present invention have been shown and described, it will be understood to those skilled in the art that a variety of changes, modifications, substitutions and variations of these embodiments can be made without departing from the principles and spirits of the present invention, and the scope of the present invention is limited by the appended claims and their equivalents.

The invention claimed is:

1. A double-channel fluid injection apparatus, comprising a main shaft, a bearing box and a sealing box, wherein the main shaft comprises an outer tube and an inner tube, the outer tube being cylindrical and provided with a vertical through channel C extending axially therein, with a stepped hole recessed outwardly at an upper end of the channel C;

the inner tube is shaped as a round tube, with an outwardly extending boss formed at an upper end thereof, and is inserted into the channel C of the outer tube from top to bottom, so that a lower end face of the boss of the inner tube is abutted against a lower end face of the stepped hole of the outer tube, while an outer edge of the boss of the inner tube is fixedly connected with an inner edge of the stepped hole of the outer tube;

the inner tube is provided therein with a channel B, which, together with the vertical through channel C, constitutes a first fluid passageway;

an annular channel formed by a lower portion of an outer edge of the inner tube and a lower portion of an inner edge of the outer tube is an annular gap B, wherein a lower part of the outer tube is provided with a channel D extending radially, which is in communication with the annular gap B to constitute a second fluid passageway;

a connecting element is arranged at each of an upper end and a lower end of the outer tube, and a plug-in sealing element is arranged at a lower end of the inner tube;

an outer edge of an upper part of the outer tube is provided with a boss, on which the bearing box is mounted to form a rotatable and sealable fit with the outer tube; and the sealing box comprises a sealing cylinder of a cylindrical structure, which is fixedly connected to a lower end of a lower end cap of the bearing box, and constitutes a rotatable and sealable fit with the outer tube, wherein a channel E extending radially is formed at a position of the sealing cylinder corresponding to the channel D at the lower part of the outer tube, the channel E being in communication with the second fluid passageway.

2. The double-channel fluid injection apparatus of claim 1, wherein the bearing box includes an upper end cap, the lower end cap, a housing, a bearing set, end cap sealing rings, and oil seals, wherein the bearing set is mounted above and below the boss arranged at the outer edge of the upper part of the outer tube, and the housing is mounted around the bearing set;

the upper end cap and the lower end cap are respectively mounted at an upper end and a lower end of the housing;

the end cap sealing rings are respectively mounted between the upper end cap and the housing and between the lower end cap and the housing; and the oil seals are respectively mounted between the upper end cap and the outer tube and between the lower end cap and the outer tube.

3. The double-channel fluid injection apparatus of claim 1, wherein the sealing box further comprises an upper sliding sleeve, a lower sliding sleeve, an upper sealing ring, a lower sealing ring and a lower sealing cap, wherein the lower sealing cap is mounted on a lower end of the sealing cylinder, and the sealing cylinder and the lower sealing cap are both sleeved on the outer edge of the outer tube;

a channel E extending radially is formed in a middle part of the sealing cylinder, and the upper sealing ring and the upper sliding sleeve are arranged between an inner edge of the sealing cylinder and the outer edge of the outer tube and between the channel E and the lower end cap of the bearing box, respectively, the upper sealing ring being located below the upper sliding sleeve;

between the lower end cap of the bearing box and the sealing cylinder an upper piston chamber is formed, in which the upper sliding sleeve is arranged, and a radial channel F in communication with the upper piston chamber is formed in an upper part of the sealing cylinder, so that a part of hydraulic medium flows to the channel F to drive the upper sliding sleeve to press the upper sealing ring;

the lower sealing ring and the lower sliding sleeve are arranged between the inner edge of the sealing cylinder and the outer edge of the outer tube and between the channel E and the lower sealing cap, the lower sealing ring being located above the lower sliding sleeve; and between the lower sealing cap and the sealing cylinder a lower piston chamber is formed, in which the lower sliding sleeve is arranged, and a radial channel G in communication with the lower piston chamber is formed in a lower part of the sealing cylinder, so that another part of hydraulic medium flows to the channel G to drive the lower sliding sleeve to press the lower sealing ring.

4. The double-channel fluid injection apparatus of claim 3, wherein rotary seals are further arranged between the upper sealing ring and the channel E and between the lower sealing ring and the channel E, respectively.

5. The double-channel fluid injection apparatus of claim 4, wherein the upper sealing ring and the lower sealing ring are V-shaped combined sealing rings.

6. The double-channel fluid injection apparatus of claim 1, wherein the outer edge of the boss of the inner tube is connected to the inner edge of the stepped hole of the outer tube through threads, and a sealing ring A is arranged between the inner tube and the outer tube.

* * * * *